United States Patent [19]

Roche

[11] 4,413,209

[45] Nov. 1, 1983

[54] SERIES-CONNECTED DISCHARGE DEVICE BALLAST APPARATUS

[75] Inventor: William J. Roche, Merrimac, Mass.

[73] Assignee: GTE Products Corporation, Stamford, Conn.

[21] Appl. No.: 308,295

[22] Filed: Oct. 5, 1981

[51] Int. Cl.[3] ..... H05B 41/16

[52] U.S. Cl. ..... 315/101; 315/96; 315/99; 315/189; 315/201; 315/323; 315/DIG. 5

[58] Field of Search ..... 315/96, 99, 101, 105, 315/122, 189, 200 R, 201, 323, 324, DIG. 5; 328/7; 307/326

[56] References Cited

U.S. PATENT DOCUMENTS 4,122,374 10/1978 Studli ..... 315/101 X

*Primary Examiner*—Eugene R. LaRoche

*Attorney, Agent, or Firm*—Thomas H. Buffton

[57] ABSTRACT

A ballast apparatus for series-sequenced gaseous discharge devices having series-connected filaments wherein a transformer is connected to a potential source and to a pair of series-sequenced gaseous discharge devices with a starting capacitor shunting one of the gaseous discharge devices and a circuit means series-connects a filament of each of the gaseous discharge devices to the transformer by way of a rectifier means.

12 Claims, 4 Drawing Figures

SERIES-CONNECTED DISCHARGE DEVICE BALLAST APPARATUS

A concurrently filed application entitled "Voltage Limited Ballast For Gaseous Discharge Devices," assigned to the Assignee of the present application in the name of the present inventor and having U.S. Ser. No. 308,303, relates to voltage limited series-sequenced series-connected gaseous discharge devices.

TECHNICAL FIELD

This invention relates to ballast apparatus for series-sequenced gaseous discharge devices and more particularly to ballast apparatus for series-connecting filaments for series-sequenced gaseous discharge devices.

BACKGROUND ART

Series-sequenced gaseous discharge devices, such as fluorescent lamps, are usually coupled to ballast apparatus which includes a transformer coupled to a potential source and to the ends of the series-sequenced gaseous discharge devices. A filament from each of the discharge devices is parallel-connected and these parallel connected filaments are coupled to a transformer which provides the energy necessary to operate the filaments. Usually, a starting capacitor shunts one of the series-sequenced discharge devices to provide an increased potential for initiating conduction in the un-shunted discharge device and, subsequently, in the shunted discharge device.

Although the above-described series-sequenced ballast apparatus and gaseous discharge devices utilizing a parallel-connected filament arrangement have been and still are employed in numerous applications, it has been found that such a circuit configuration does leave something to be desired. More specifically, series-sequenced discharge devices employing parallel-connected filaments tend to require relatively complex and expensive wiring arrangements. Moreover, energy losses in ballast apparatus designed for series-sequenced lamps with parallel-connected filaments tend to exceed the energy losses of series-sequenced lamps wherein the filaments are series-connected.

However, even though the above-mentioned advantages of series-connected filaments for series-sequenced discharge devices have been known for some time, large scale implementation of series-connected discharge devices has been delayed due to a serious impairment of lamp performance with such a series-connected circuit configuration. More specifically, it has been found that removal or failure of one of the discharge devices results in an undesirable condition wherein the remaining gaseous discharge device operates in a so called cold cathode glow discharge condition.

As an example, FIG. 1 illustrates a prior art series-sequenced series-connected configuration. Herein, a transformer 5 is coupled to the opposite ends of a pair of series-sequenced gaseous discharge devices 7 and 9 respectively. A capacitor 11 shunts one of the discharge devices 7, and a circuit means 13 series-connects a filament of each of the discharge devices 7 and 9 to the transformer 5.

In operation, failure of the discharge device 7, specifically the series-connected filament of discharge device 7, would interrupt the series-connected circuit means 13 and inhibit heating energy to the filament of the discharge device 9. However, current would undesirably flow by way of the transformer 5, shunting capacitor 11 and the circuit means 13 to the other discharge device 9. Thus, the other gaseous discharge device would operate in a cold cathode glow discharge mode which is both undesirable and deleterious to extended utilization of the other gaseous discharge device 9, to wit, failure of device 9.

OBJECTS AND SUMMARY OF THE INVENTION

An object of the present invention is to provide improved ballast apparatus for series-sequenced gaseous discharge devices. Another object of the invention is to provide an enhanced ballast apparatus for series-connected filaments in series-sequenced gaseous discharge devices. Still another object of the invention is to provide improved ballast apparatus which prevents cold cathode operation of series-connected filaments employed in series-sequenced gaseous discharge devices. A further object of the invention is to provide ballast apparatus for protecting one gaseous discharge device when the other gaseous discharge device of a pair of series-connected series-sequenced gaseous discharge devices is inoperative.

These and other objects, advantages and capabilities are achieved in one aspect of the invention by a ballast apparatus having a transformer coupled to a potential source and to a pair of series-connected filaments of series-sequenced gaseous discharge devices wherein a rectifier means couples the series-connected filaments to the transformer.

BEST MODE FOR CARRYING OUT THE INVENTION

For a better understanding of the present invention, together with other and further objects, advantages and capabilities thereof, reference is made to the following disclosure and appended claims in conjunction with the accompanying drawings.

Figure 2:
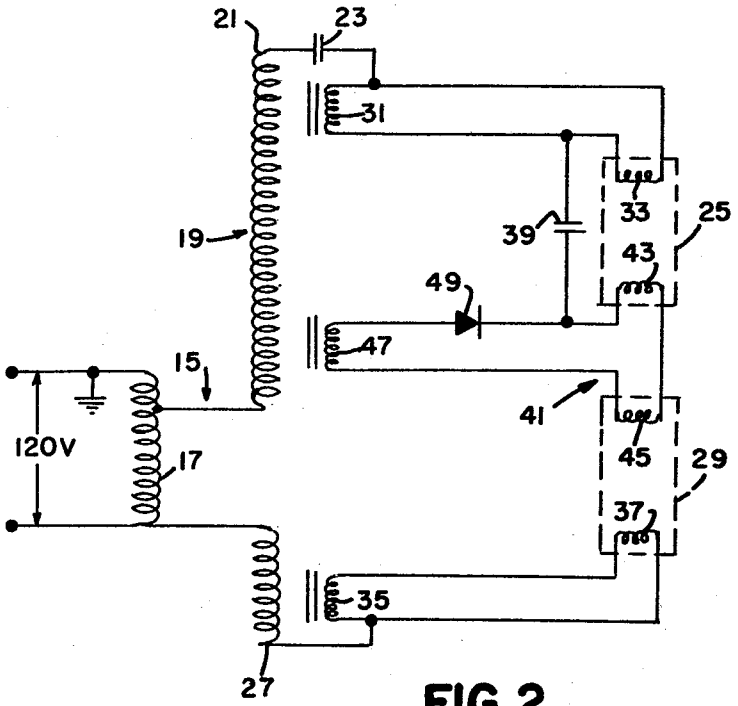
FIG. 2 is a preferred embodiment of the invention having a rectifier means coupling series-connected filaments to an energization source.

Referring to the drawings, FIG. 2 illustrates a preferred ballast apparatus for a series-sequenced series-connected filament pair of gaseous discharge devices. Herein, an autotransformer 15 has a primary winding 17 coupled to a potential source (not shown) such as a 120-volt AC source. A secondary winding 19 has one end 21 coupled by a power capacitor 23 to one end of a gaseous discharge device 25 and the other end 27 coupled to one end of another gaseous discharge device 29.

A first filament winding 31 of the transformer 15 is coupled to a filament 33 of the one gaseous discharge device 25, and a second filament winding 35 is coupled to a filament 37 of the other gaseous discharge device 29. A starting capacitor 39 shunts the one gaseous discharge device 25. A circuit means 41 series-connects a filament 43 of the one discharge device 25 and a filament 45 of the other discharge device 29. The circuit means 41 is connected to a third filament winding 47 of the transformer 15 by way of a rectifier means 49.

As to operation, it has previously been noted that series-connected circuitry wherein the discharge device 25 shunted by a capacitor 39 is missing or inoperative due to filament 43 failure and the rectifier means or diode 49 is not present results in a cold cathode glow discharge mode of operation for other gaseous discharge device 29.

However, it can be seen that the added rectifier means or diode 49 prevents such a cold cathode glow discharge mode of operation of the gaseous discharge device 29 when the other gaseous discharge device 25 is inoperative. Under such conditions, the removal of the filament 43 interrupts the cold cathode discharge circuit.

Thus, the current path which includes the transformer 15, power capacitor 23, filament winding 31, starting capacitor 39, filament winding 47 and filament 45 is no longer available because of the rectifier means or diode 49. As a result, an inoperational condition of the one gaseous discharge device 25 is accompanied by an inoperational condition of the other gaseous discharge device 29. Therefore, series-connected filaments in series-sequenced gaseous discharge devices is feasible without deleterious effects due to cold cathode operation of gaseous discharge device 29 upon failure of the gaseous discharge device 25.

Figure 3:
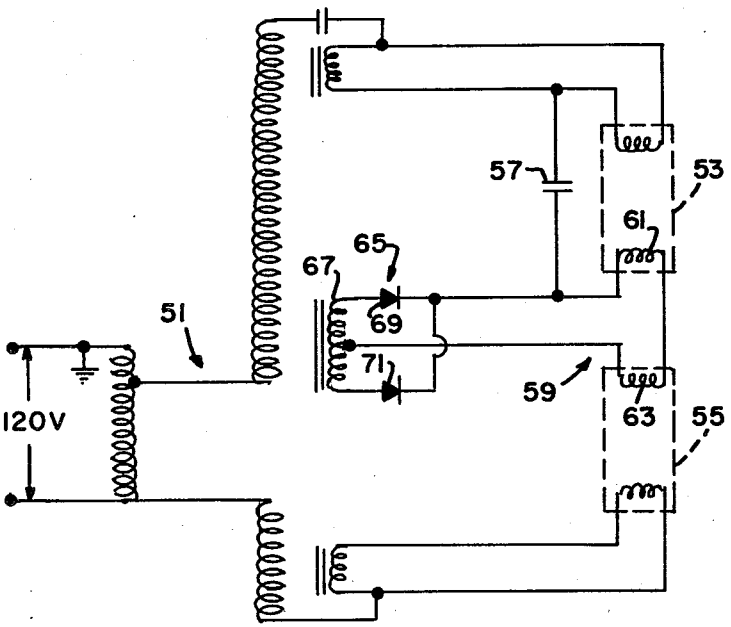
FIG. 3 is an alternate embodiment of a ballast apparatus for series-connected filaments employed in series-sequenced gaseous discharge devices.

Alternatively, FIG. 3 illustrates an embodiment wherein an autotransformer 51 is coupled to a series-sequenced series-connected filament pair of gaseous discharge devices 53 and 55. A starting capacitor 57 shunts the one gaseous discharge device 53. Also, a circuit means 59 series-connects a filament 61 of the discharge device 53 and a filament 63 of the discharge device 55 to a full-wave rectifier means 65 including a center-tapped filament transformer winding 67 with a first and second diode 69 and 71 connected to opposite ends of the winding 67.

Operation of the above-described circuit configuration is similar to the operation of the circuit configuration of FIG. 2 except for the substitution of a full-wave rectifier 65 for the rectifier means 49 of FIG. 2. Moreover, it can be seen that the rectifier means 65 serves to inhibit current flow in the gaseous discharge device 55 whenever the other gaseous discharge device 53 is inoperational.

Figure 4:
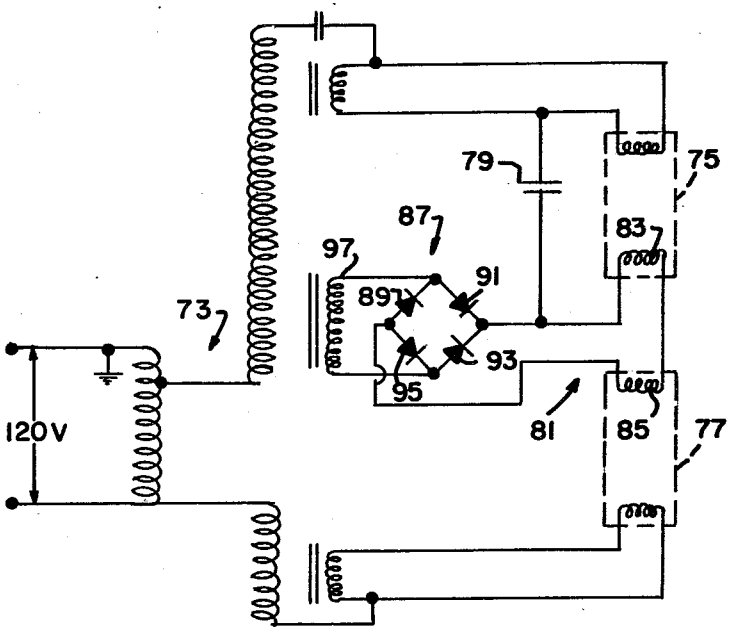
FIG. 4 is another alternate embodiment of a ballast apparatus for series connected filaments employed in series-sequenced gaseous discharge devices.

In still another embodiment, FIG. 4 illustrates a circuit configuration having an autotransformer 73 coupled to a pair of series-sequenced series-connected gaseous discharge devices 75 and 77 respectively. A starting capacitor 79 shunts the one gaseous discharge device 75 and a circuit means 81 series-connects a filament 83 of the one discharge device 75 and a filament 85 of the other discharge device 77 to a full-wave diode bridge circuit 87. Moreover, the diode bridge circuit 87 includes four bridge-connected diodes 89, 91, 93 and 95 coupled to a filament winding 97 of the transformer 73 and to the circuit means 81.

Again, operation of the circuitry is similar to the embodiment of FIG. 3 in that a full-wave bridge circuit 87 is substituted for the rectifier means 65. Thus, the rectifier means 87 inhibits a cold cathode discharge mode of operation of the gaseous discharge device 77 whenever the other gaseous discharge device 75 is inoperational.

Figure 1:
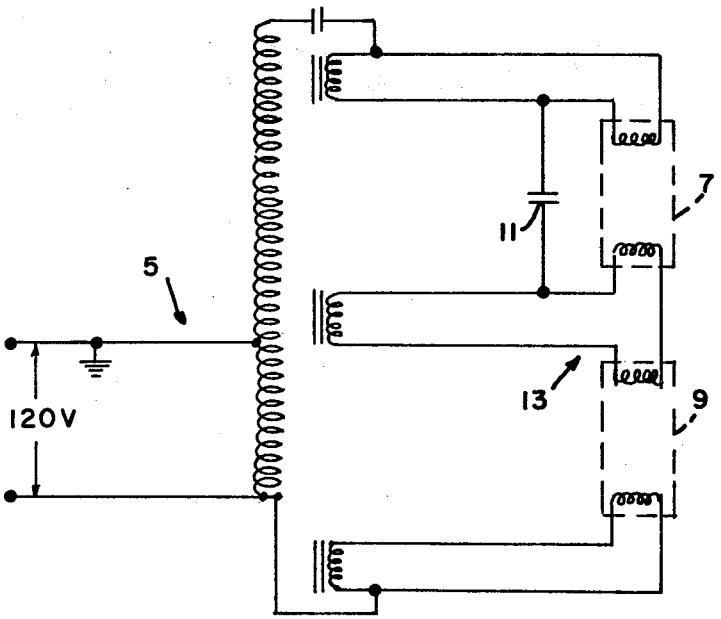
FIG. 1 PRIOR ART
FIG. 1 illustrates a known ballast apparatus for series-sequenced gaseous discharge devices.

Additionally, it should perhaps be noted that the enhanced apparatus and capabilities provided and discussed above relating to the embodiments of FIGS. 2, 3 and 4 are also adaptable to the prior art configuration of FIG. 1. In other words, the T-12 lamp system of FIG. 1 may be altered in the manner described for the T-8 lamp systems of FIGS. 2, 3 and 4 to provide an improved series-connected filament system wherein a so-called cold cathode glow discharge condition is not encountered even when one discharge device fails or is removed.

While there have been shown and described what is at present considered the preferred embodiments of the invention, it will be obvious to those skilled in the art that various changes and modifications may be made therein without departing from the invention as defined by the appended claims.

INDUSTRIAL APPLICABILITY

Improved ballast apparatus for series-sequenced series-connected gaseous discharge devices with a series-connected filaments prevents cold cathode operation of a remaining gaseous discharge device when the other one of a pair of gaseous discharge devices is inoperational. Thus, failure of one gaseous discharge device is not only quickly discernible since the other discharge device also becomes inoperative, but, more importantly, the remaining discharge device is not deleteriously affected by failure of the other device. Thus, series-connection of the gaseous discharge devices becomes desirable due to the reductions in wiring costs and simplification of the wiring configurations.

I claim:

1. A ballast apparatus for starting and operating at least one pair of series-sequenced gaseous discharge devices wherein a transformer is coupled to a potential source and to opposite ends of said pair of series-sequenced gaseous discharge devices, a starting capacitor shunts one of the gaseous discharge devices and a filament of each of said gaseous discharge devices is connected in series by a circuit means and coupled to a filament winding of said transformer by way of a rectifier means whereby said rectifier means prevents operation of one discharge device when the other discharge device is operative.

2. The ballast apparatus of claim 1 wherein said transformer is in the form of an autotransformer having a primary winding coupled to a potential source and a secondary winding coupled to a pair of series-sequenced gaseous discharge devices with series-connected filaments.

3. The ballast apparatus of claim 1 wherein said pair of series-sequenced gaseous discharge devices having series-connected filaments has one end coupled by a power capacitor and the other end directly coupled to said transformer.

4. The ballast apparatus of claim 1 wherein said rectifier means is in the form of a diode coupling said series-connected. circuit means and filament windings of said transformer.

5. The ballast apparatus of claim 1 wherein said rectifier means is in the form of a full-wave rectifier means.

6. The ballast apparatus of claim 1 wherein said rectifier means is in the form of a pair of diodes connected to opposite ends of a center-tapped filament winding coupled to said circuit means.

7. The ballast apparatus of claim 1 wherein said rectifier means is in the form of a full-wave diode bridge circuit.

8. A ballast apparatus for starting and operating a pair of series-sequenced gaseous discharge devices comprising a transformer coupled to a potential source with a secondary winding having one end coupled by a power capacitor to one end of said series-sequenced gaseous discharge devices and the opposite end directly connected to the opposite end of said series-sequenced gaseous discharge devices, a starting capacitor shunting one of said pair of gaseous discharge devices, and a circuit means coupling a filament of each one of said pair of gaseous discharge devices connected in series and to a filament winding of said transformer by way of a rectifier means.

9. The ballast apparatus of claim 8 wherein said rectifier means is in the form of a half-wave diode rectifier.

10. The ballast apparatus of claim 8 wherein said rectifier means is in the form of a full-wave rectifier.

11. The ballast apparatus of claim 8 wherein said rectifier means is in the form of a full-wave rectifier having a pair of diodes connected to opposite ends of a center-tapped filament winding of said transformer and to said circuit means.

12. The ballast apparatus of claim 8 wherein said rectifier means is in the form of a full-wave diode bridge circuit.

* * * * *